US008356866B2

(12) United States Patent
Cho et al.

(10) Patent No.: US 8,356,866 B2
(45) Date of Patent: Jan. 22, 2013

(54) REFRIGERATOR WITH DOOR OPENING DEVICE

(75) Inventors: Kyu Su Cho, Gwangsan-gu (KR); Jae Sek Oh, Kwangju (KR); Dong In Shin, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 308 days.

(21) Appl. No.: 12/659,028

(22) Filed: Feb. 23, 2010

(65) Prior Publication Data

US 2010/0270900 A1 Oct. 28, 2010

(30) Foreign Application Priority Data

Apr. 28, 2009 (KR) ..... 10-2009-0037285

(51) Int. Cl.
*A47B 96/04* (2006.01)

(52) U.S. Cl. ..... 312/405; 16/412

(58) Field of Classification Search ..... 312/402, 312/332.1, 404, 405, 405.1; 16/412; 62/440, 62/265, 449; 49/489.1, 492.1, 498.1, 493.1
See application file for complete search history.

(56) References Cited

U.S. PATENT DOCUMENTS

| | | | | |
|---|---|---|---|---|
| 2,659,115 | A * | 11/1953 | Anderson et al. | 49/277 |
| 2,889,787 | A * | 6/1959 | Schell | 109/63.5 |
| 5,908,228 | A * | 6/1999 | Lee | 312/405 |
| 5,915,805 | A * | 6/1999 | Lee | 312/405 |
| 6,375,291 | B1 * | 4/2002 | Nam et al. | 312/405 |
| 6,655,765 | B2 * | 12/2003 | Kawamura et al. | 312/405 |
| 7,195,293 | B2 * | 3/2007 | Ala | 292/254 |
| 7,765,645 | B2 * | 8/2010 | Kim | 16/412 |
| 8,025,349 | B2 * | 9/2011 | Lim et al. | 312/405 |
| 8,132,876 | B2 * | 3/2012 | An et al. | 312/405 |
| 2008/0000052 | A1 * | 1/2008 | Hong et al. | 16/382 |
| 2009/0179540 | A1 * | 7/2009 | Seo | 312/405 |

FOREIGN PATENT DOCUMENTS

| | | | |
|---|---|---|---|
| EP | 1174668 | A1 * | 1/2002 |
| KR | 20-1999-0020199 | | 6/1999 |
| KR | 10-2001-0026279 | | 4/2001 |
| KR | 10-2008-0065361 | | 7/2008 |

* cited by examiner

*Primary Examiner* — Hanh V Tran
(74) *Attorney, Agent, or Firm* — Staas & Halsey LLP

(57) ABSTRACT

A refrigerator with a door opening device. The door opening device includes a first rotating frame and a second rotating frame rotatably hinged to an upper end and a lower end of the door, a handle extended in the longitudinal direction of the door, and provided with one end connected to one end of the first rotating frame and the other end connected to one end of the second rotating frame, and a stopper unit to selectively restrict rotation of at least one of the first rotating frame and the second rotating frame relative to the door.

15 Claims, 19 Drawing Sheets

REFRIGERATOR WITH DOOR OPENING DEVICE

CROSS-REFERENCE TO RELATED APPLICATIONS

This application claims the benefit of Korean Patent Application No. 2009-0037285, filed on Apr. 28, 2009 in the Korean Intellectual Property Office, the disclosure of which is incorporated herein by reference.

BACKGROUND

1. Field

Embodiments relate to a refrigerator with a door opening device.

2. Description of the Related Art

Refrigerators are apparatuses that supply cool air generated by a refrigerating cycle to storage chambers to maintain freshness of food for a long time.

In general, a refrigerator includes a cabinet, in which storage chambers are formed, doors hinged to the cabinet to open and close the storage chambers, and handles respectively protruded from the front surfaces of the doors to a designated height. A user grips and pulls the handle, thus opening the corresponding door. Recently, a refrigerator having an easy open type handle structure to open a door using a relatively small force has been developed and manufactured.

However, in the above conventional refrigerator, the handle is protruded from the front surface of the corresponding door to a designated height, and thus a large size transportation space is required when the refrigerator is transported prior to installation of the refrigerator. That is, circulation efficiency is low.

Further, as the protruding height of the handle from the front surface of the refrigerator is increased, a possibility that the handle is damaged by external impact may be increased. That is, durability of the refrigerator is deteriorated.

SUMMARY

Therefore, it is one aspect to provide a refrigerator, which has an improved circulation efficiency.

It is another aspect to provide a refrigerator, which has an improved durability.

Additional aspects will be set forth in part in the description which follows and, in part, will be apparent from the description, or may be learned by practice of the embodiments.

In accordance with one aspect, in a refrigerator, which has a cabinet provided with at least one storage chamber, a door hinged to the cabinet to open and close the at least one storage chamber, and a door opening device provided on the door to open the door, the door opening device includes a first rotating frame and a second rotating frame rotatably hinged to an upper end and a lower end of the door, a handle extended in the longitudinal direction of the door, and provided with one end connected to one end of the first rotating frame and the other end connected to one end of the second rotating frame, and a stopper unit to selectively restrict rotation of at least one of the first rotating frame and the second rotating frame relative to the door to maintain an interval between the handle and the door within a designated distance.

The stopper unit may include a stopper protruding from at least one end out of the upper end and the lower end of the door, and a locking part provided on at least one out of the first rotating frame and the second rotating frame to be locked with a tip of the stopper.

The stopper unit may further include a stopper guide hole provided on the at least one end out of the upper end and the lower end of the door to guide forward and backward movement of the stopper, and an elastic body inserted into the stopper guide hole to elastically support the stopper.

The door opening device may further include a cap selectively connected to the rotating frame provided with the locking part, and the cap may be provided with a pressure part applying pressure to the stopper toward the door to release the locking of the stopper with the locking part under the condition that the cap is connected to the rotating frame.

The rotating frame provided with the locking part may include a guide part to guide the tip of the stopper when the first rotating frame and the second rotating frame are rotated.

An extension part may be provided at the other end of at least one of the first rotating frame and the second rotating frame, being opposite to the end thereof, to which the handle is connected, based on the center of rotation thereof, and the extension part may selectively apply pressure to the cabinet according to the rotations of the first rotating frame and the second rotating frame.

A rotating roller may be provided on the extension part, and the rotating roller may contact the cabinet and roll on the cabinet to apply pressure to the cabinet when the door is opened.

The door opening device may further include a locking frame provided with the locking part, and the locking frame may be connected to the rotating frame corresponding to the stopper such that relative rotation of the locking frame against the rotating frame is restricted.

The locking frame may be connected to the rotating frame in at least two orientations, and be provided with a guide part, into which the tip of the stopper is inserted to be guided. If the locking frame is connected to the rotating frame in a first orientation, the locking part of the locking frame may be locked with the tip of the stopper and thus the rotation of the rotating frame may be restricted, and if the locking frame is connected to the rotating frame in a second orientation, the tip of the stopper may be inserted into the guide part of the locking frame and guided by the guide part, when the rotating frame is rotated.

The stopper unit may include a through hole formed through at least one of the first rotating frame and the second rotating frame, a fixing hole formed on one end of the door corresponding to the through hole, and a stopper provided with a tip inserted into the fixing hole via the through hole at a designated rotating angle of the rotating frame provided with the through hole to restrict the rotation of the rotating frame relative to the door.

In accordance with another aspect, in a refrigerator, which has a cabinet provided with at least one storage chamber, a door hinged to the cabinet to open and close the at least one storage chamber, and a door opening device provided on the door to open the door, the door opening device includes a shaft reception hole provided on at least one end of an upper end and a lower end of the door, a shaft received in the shaft reception hole, a rotating frame provided with one end connected to the shaft and the other end connected to a handle, an elastic body to elastically bias the rotating frame, and a stopper provided on the door to selectively restrict rotation of the rotating frame.

The stopper may be provided on the door such that the stopper is movable between a first position and a second position. At the first position, locking between the stopper and the corresponding rotating frame may be generated and the rotation of the rotating frame may be restricted to maintain a close approach state of the handle to the door, and at the second position, the locking between the stopper and the corresponding rotating frame may be released.

The door opening device may further include a stopper guide hole provided on the door, and an elastic body inserted into the stopper guide hole to elastically support the stopper.

The door opening device may further include a cap connected to the rotating frame, and the cap may apply pressure to the stopper to release the restriction of the rotation of the rotating frame by the stopper.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
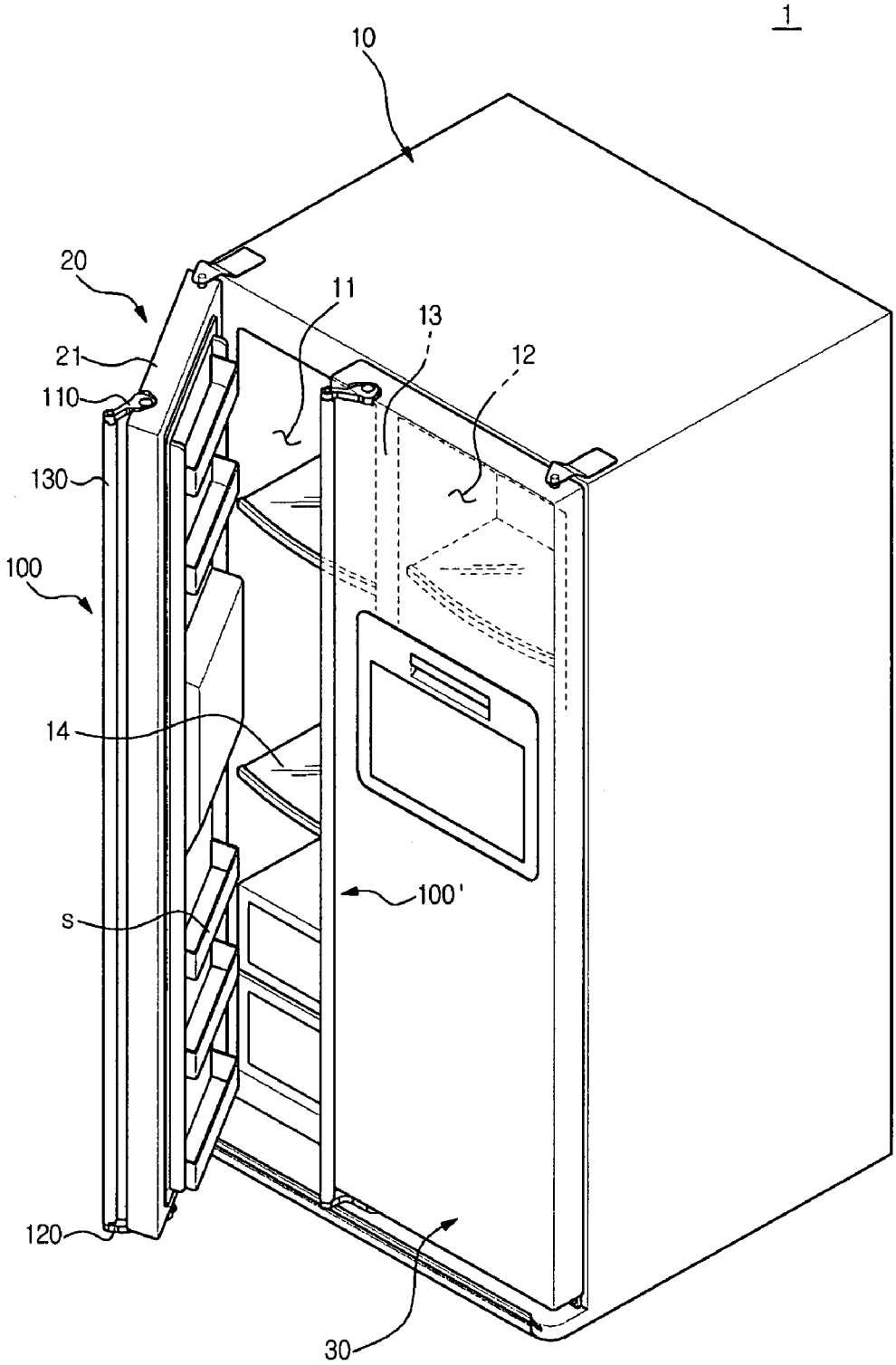
FIG. 1 is a perspective view illustrating a refrigerator in accordance with one embodiment.

Reference will now be made in detail to the embodiments, examples of which are illustrated in the accompanying drawings, wherein like reference numerals refer to like elements throughout.

Figure 2:
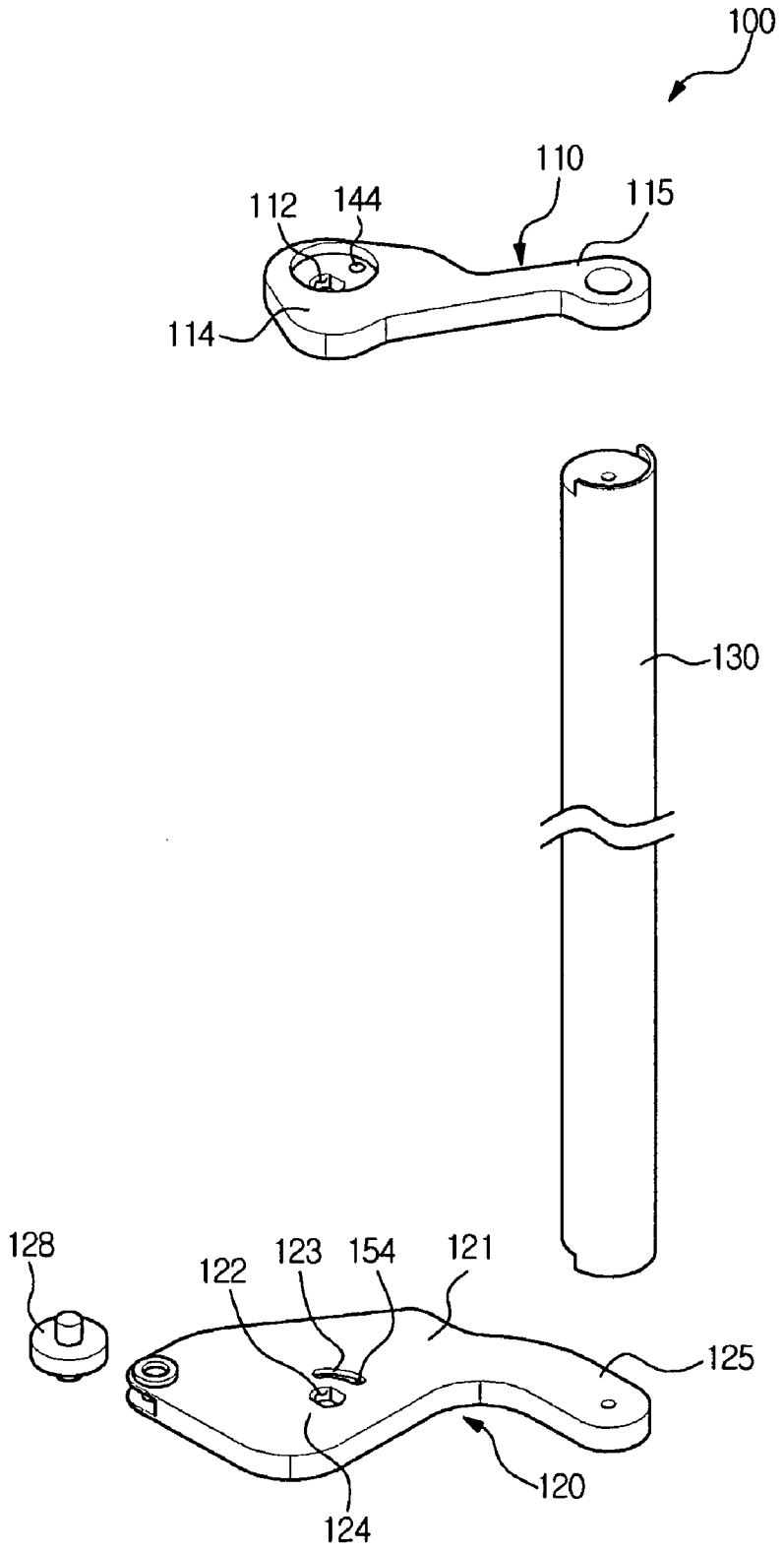
FIG. 2 is a perspective view illustrating a first rotating frame, a second rotating frame, and a handle in accordance with the embodiment.
Figure 3:
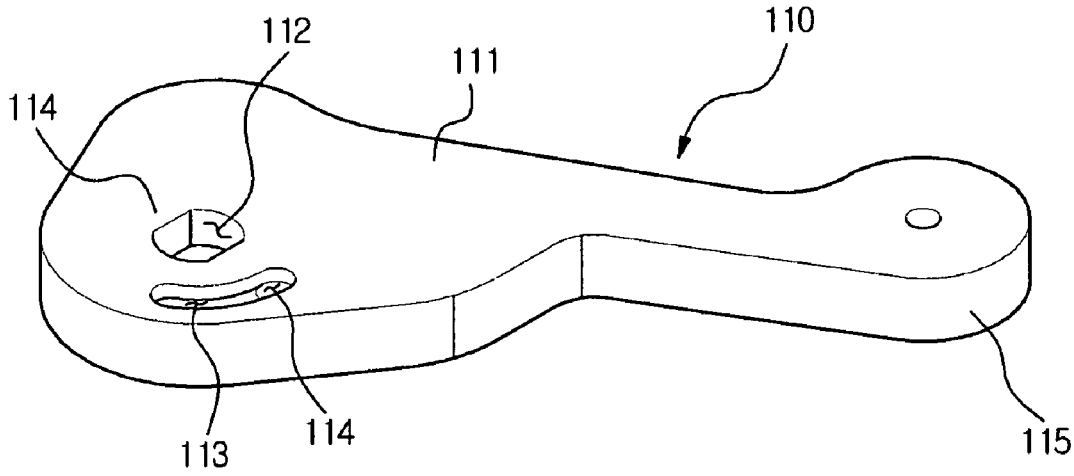
FIG. 3 is a perspective view illustrating a surface of the first rotating frame opposite to a door.

FIG. 1 is a perspective view illustrating a refrigerator in accordance with one embodiment, FIG. 2 is a perspective view illustrating a first rotating frame, a second rotating frame, and a handle in accordance with the embodiment, and FIG. 3 is a perspective view illustrating a surface of the first rotating frame opposite to a door.

As shown in FIGS. 1 to 3, a refrigerator 1 in accordance with this embodiment includes a cabinet 10, in which a plurality of storage chambers 11 and 12 are formed, doors 20 and 30 respectively provided at the front surfaces of the storage chambers 11 and 12 to open and close the storage chambers 11 and 12, cool air supply devices (not shown) respectively provided in the storage chambers 11 and 12 to supply cool air to the insides of the storage chambers 11 and 12, and a machinery chamber (not shown) provided at the rear region of the lower portion of the cabinet 10 such that electric parts, such as a compressor, are installed in the machinery chamber. The compressor (not shown), a condenser (not shown), an expansion device (not shown), and an evaporator (not shown) form a refrigerating cycle, and cool air to be discharged to the cool air supply devices is generated by the refrigerating cycle.

The cabinet 10 includes an internal case and an external case, and a space between the internal case and the external case of the cabinet 10 is filled with a foaming agent for insulation.

The storage chambers 11 and 12 are divided by a diaphragm 13, and include a first storage chamber 11 provided at the left portion of the cabinet 10 and a second storage chamber 12 provided at the right portion of the cabinet 10. Racks 14 to receive food to be stored in a cold state are respectively provided in the storage chambers 11 and 12.

A first door 20 and a second door 30 are respectively hinged to the front surfaces of the first storage chamber 11 and the second storage chamber 12, thus respectively opening and closing the first storage chamber 11 and the second storage chamber 12. Here, a reference mark s represents racks provided on the doors 20 and 30 to receive food.

Door opening devices 100 and 100' to open the doors 20 and 30 are respectively provided on the first door 20 and the second door 30. For reference, although the door opening device 100 provided on the first door 20 will be described hereinafter, the structure of the door opening device 100 may be applied to the door opening device 100' provided on the second door 30.

The door opening device 100 includes a first rotating frame 110 and a second rotating frame 120 rotatably hinged to an upper end 21 and a lower end 22 of the first door 20, a handle 130 extended in the longitudinal direction of the first door 20 (with reference to FIG. 1) and provided with one end connected to one end of the first rotating frame 110 and the other end connected to one end of the second rotating frame 120, and a first stopper unit 140 (with reference to FIG. 4A) and a second stopper unit 150 (with reference to FIG. 5A) to selectively restrict rotations of the first rotating frame 110 and the second rotating frame 120 relative to the first door 20 to allow an interval between the handle 130 and the first door 20 to be maintained within a designated distance.

Figure 4A:
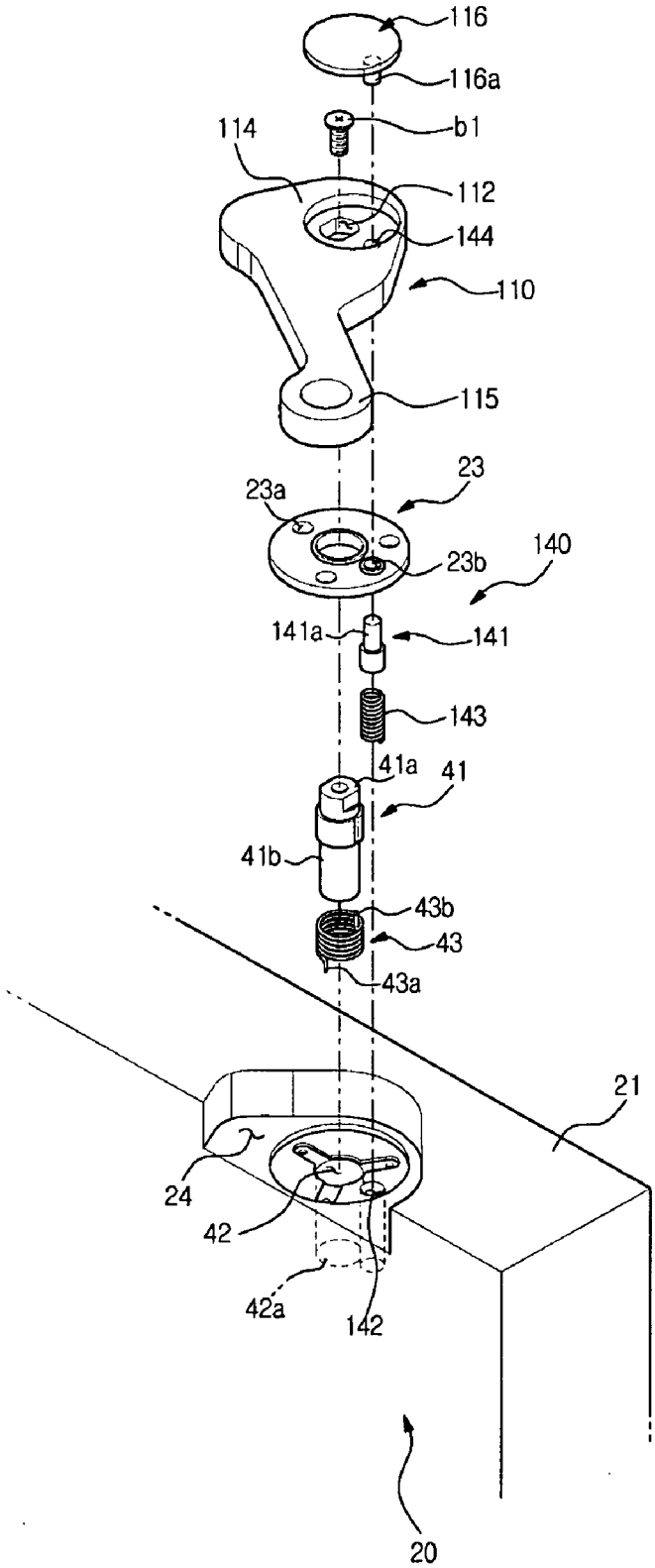
FIG. 4A is an exploded perspective view illustrating a connection structure of the first rotating frame and a first door in accordance with the embodiment.
Figure 4B:
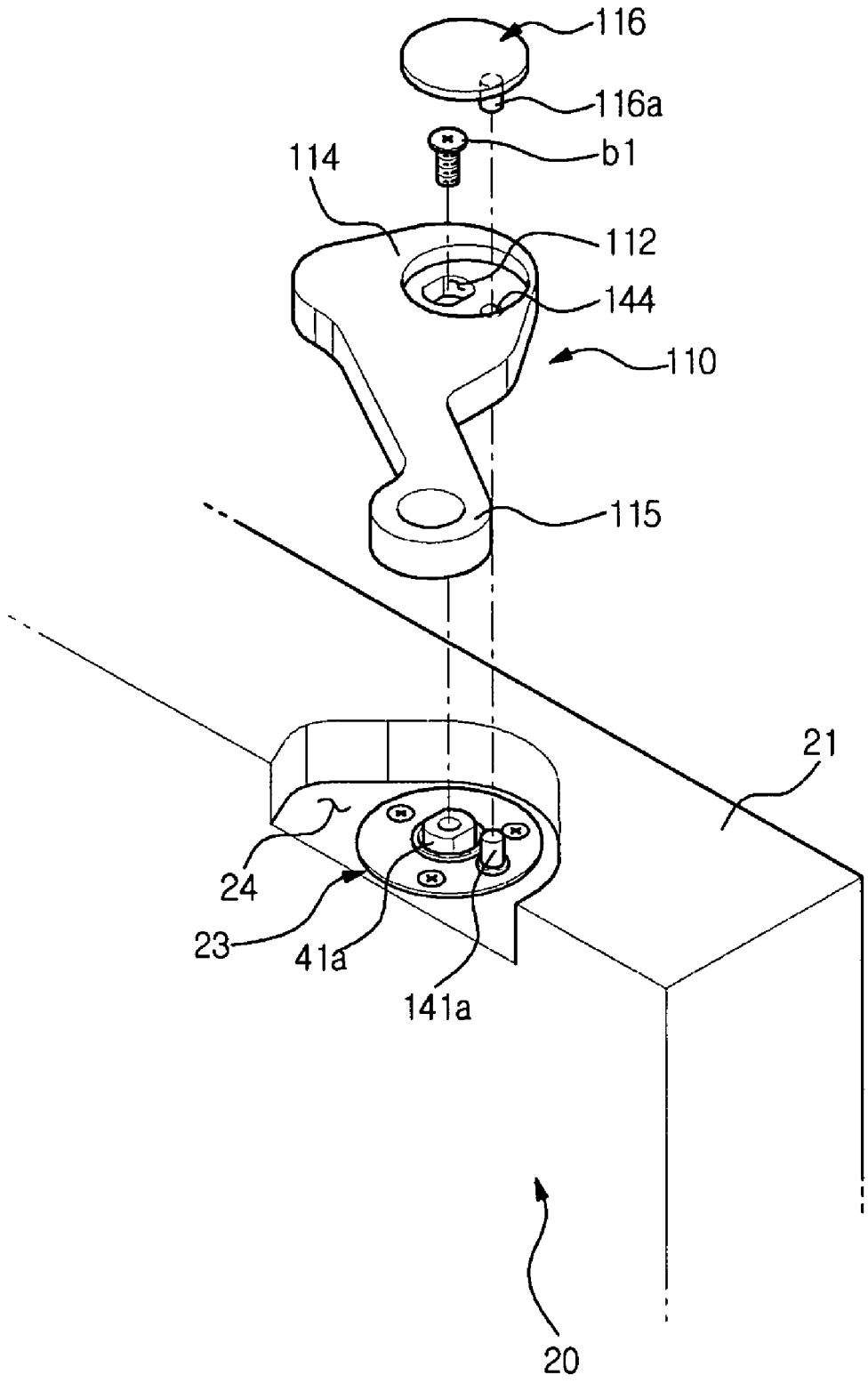
FIG. 4B is an assembled perspective view illustrating the connection structure of the first rotating frame and the first door in accordance with the embodiment.
Figure 5A:
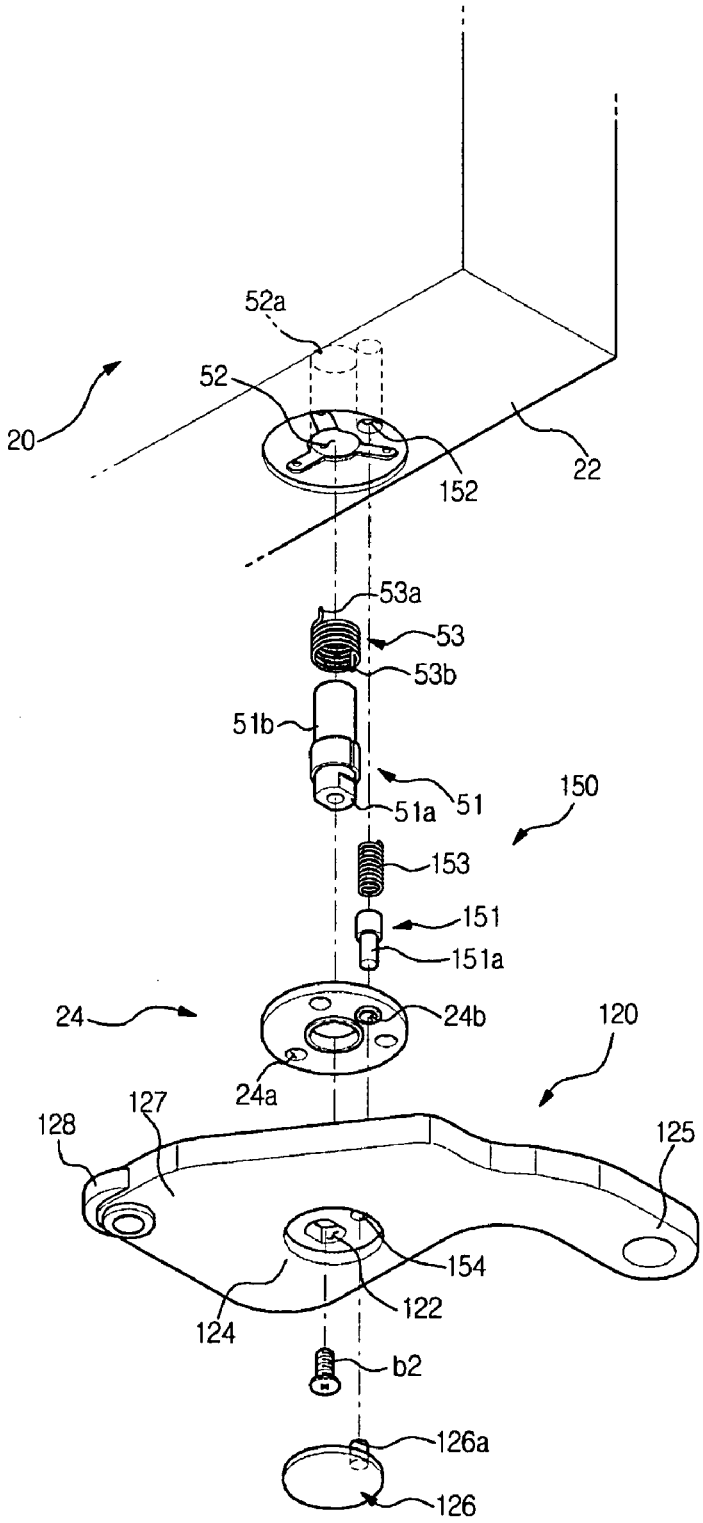
FIG. 5A is an exploded perspective view illustrating a connection structure of the second rotating frame and the first door in accordance with the embodiment.
Figure 5B:
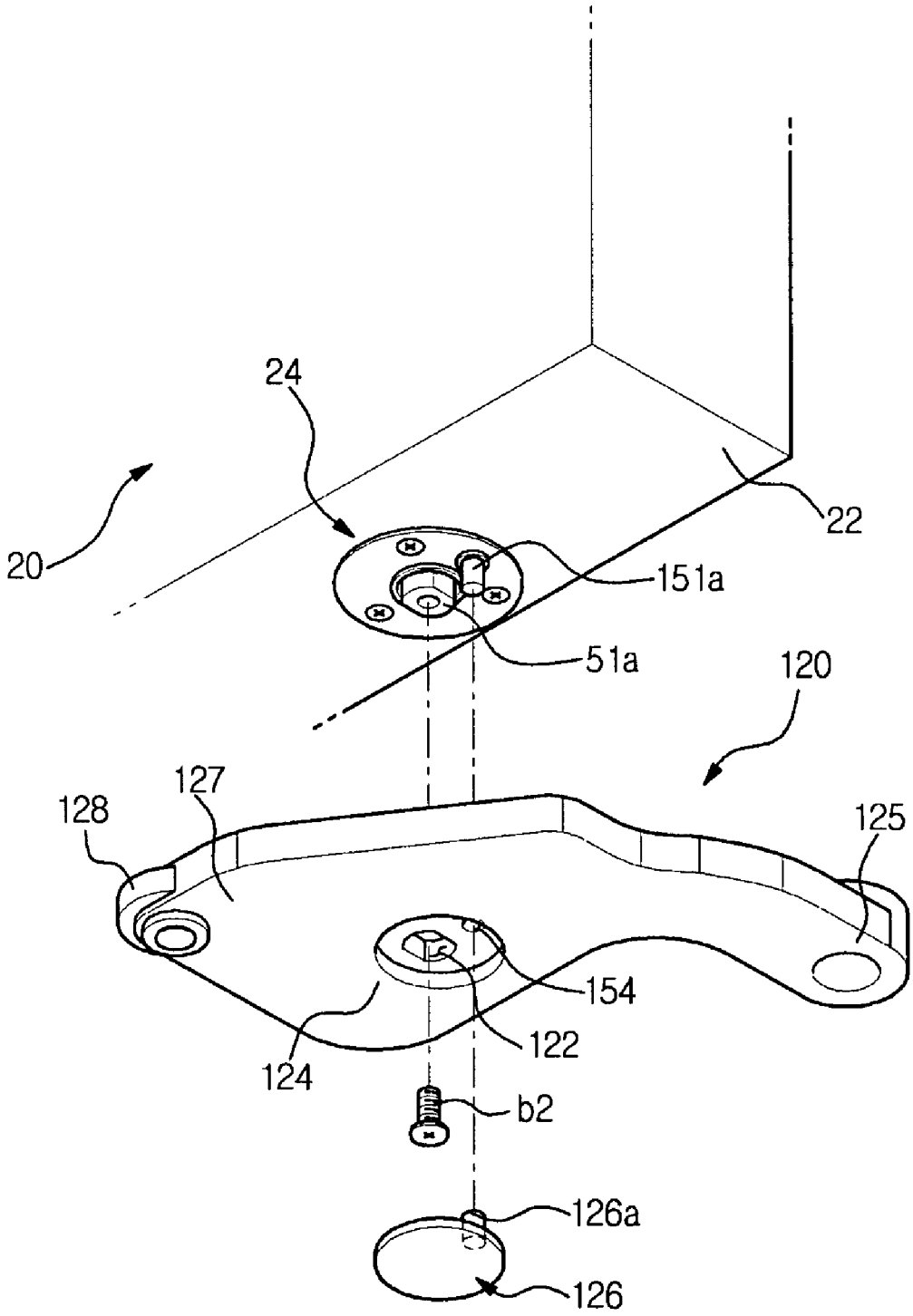
FIG. 5B is an assembled perspective view illustrating the connection structure of the second rotating frame and the first door in accordance with the embodiment.

FIGS. 4A and 4B are exploded and assembled perspective views illustrating a connection structure of the first rotating frame and the first door in accordance with this embodiment of the present invention. Further, FIGS. 5A and 5B are exploded and assembled perspective views illustrating a connection structure of the second rotating frame and the first door in accordance with this embodiment.

As shown in FIGS. 4A and 4B, the refrigerator 1 includes a first hinge shaft 41 provided with one end 41*a* having an angled shape, a first hinge hole 42 provided on the upper end 21 of the first door 20 such that the other end 41*b* of the first hinge shaft 41 is inserted into the first hinge hole 42, and a first elastic body 43 inserted into the first hinge hole 42 to elastically support the first hinge shaft 41 in one rotating direction. Here, the first elastic body 43 is formed in a torsion spring type, one end 43*a* of the first elastic body 43 is supported by a support hole 42*a* formed in the first hinge hole 42, and the other end 43*b* of the first elastic body 43 is supported by the first hinge shaft 41. Thereby, the first rotating frame 110 connected to the first hinge shaft 41 is elastically supported by the first door 20 in one rotating direction.

The first rotating frame 110 includes a connection hole 112 having a polygonal shape, into which the end 41*a* of the first hinge shaft 41 is inserted, and a locking part 144 of the first stopper unit 140, which is selectively locked with a tip 141*a* of a stopper 141 of the first stopper unit 140, which will be described later. Further, a guide part 113 (with reference to FIG. 3) is provided on one surface 111 of the first rotating frame 110 opposite to the upper end 21 of the first door 20, and the tip 141*a* of the stopper 141 is slid along the guide part 113 and guided under the condition that the locking of the stopper 141 with the locking part 144 is released. Reference numeral 114 represents a fixed terminal of the first rotating frame 110, and reference numeral 115 represents a free terminal of the first rotating frame 110, to which the handle 130 is connected. Further, reference numeral b1 represents a screw member to connect the first rotating frame 110 and the first hinge shaft 41.

The first stopper unit 140 includes the stopper 141, a stopper guide hole 142 provided on the upper end 21 of the first door 20 to guide forward and backward movement of the stopper 141, an elastic body 143 inserted into the stopper guide hole 142 to elastically support the stopper 141 in the outward direction of the first door 20, i.e., in the upward direction (with reference to FIG. 4A), and the locking part 144 provided on the first rotating frame 110 to be locked with the tip 141*a* of the stopper 141.

Reference numeral 23 represents a first cover connected to the upper end 21 of the first door 20 to prevent separation of the first hinge shaft 41, the first elastic body 43, the stopper 141, and the elastic body 143. The first cover 23 includes a plurality of screw holes 23*a*, through which connection screws are inserted, and a stopper hole 23*b*, through which the tip 141*a* of the stopper 141 is protruded.

The refrigerator 1 further includes a first cap 116 selectively connected to the first rotating frame 110. The first cap 116 is provided with a pressure part 116*a*. Under the condition that the first cap 116 is connected to the first rotating frame 110, the pressure part 116*a* of the first cap 116 applies pressure to the stopper 141 toward the first door 20, i.e., toward the stopper guide hole 142, to release the locking of the stopper 141 with the locking part 144. Thereby, restriction of rotation of the first rotating frame 110 relative to the first door 20 is released.

Under the condition that the handle 130 connected to the first rotating frame 110 closely approaches the first door 20, the tip 141*a* of the stopper 141 of the first stopper unit 140 is protruded from the upper end 21 of the first door 20 by a designated height and is inserted into the locking part 144 formed on the first rotating frame 110, and thus rotation of the first rotating frame 110 relative to the first door 20 is restricted. When the first cap 116 is connected to the first rotating frame 110, the pressure part 116*a* of the first cap 116 releases the locking of the tip 141*a* of the stopper 141 with the locking part 144 of the first rotating frame 110, and thus the first rotating frame 110 is rotated. Here, the guide part 113 provided on the first rotating frame 110 guides the tip 141*a* of the stopper 141, and defines a rotating section of the first rotating frame 110. The refrigerator 1 may further include a rotating hole 24 formed on the upper end 21 of the first door 20 to receive the fixed terminal 114 of the first rotating frame 110, and the rotating section of the first rotating frame 110 may be defined by interference between the rotating hole 24 and the first rotating frame 110.

As shown in FIGS. 5A and 5B, the refrigerator 1 includes a second hinge shaft 51 provided with one end 51*a* having an angled shape, a second hinge hole 52 provided on the lower end 22 of the first door 20 such that the other end 51*b* of the second hinge shaft 51 is inserted into the second hinge hole 52, and a second elastic body 53 inserted into the second hinge hole 52 to elastically support the second hinge shaft 51 in one rotating direction. Here, the second elastic body 53 is formed in a torsion spring type, one end 53*a* of the second elastic body 53 is supported by a support hole 52*a* formed in the second hinge hole 52, and the other end 53*b* of the second elastic body 53 is supported by the second hinge shaft 51. Thereby, the second rotating frame 120 connected to the second hinge shaft 51 is elastically supported by the first door 20 in one rotating direction.

The second rotating frame 120 includes a connection hole 122 having a polygonal shape, into which the end 51*a* of the second hinge shaft 51 is inserted, and a locking part 154 of the second stopper unit 150, which is selectively locked with a tip 151*a* of a stopper 151 of the second stopper unit 150, which will be described later. Further, a guide part 123 (with reference to FIG. 2) is provided on one surface 121 of the first rotating frame 120 opposite to the lower end 22 of the first door 20, and the tip 151*a* of the stopper 151 is slid along the guide part 123 and guided under the condition that the locking of the stopper 151 of the second stopper unit 150 with the locking part 154 is released. Reference numeral 124 represents a fixed terminal of the second rotating frame 120, and reference numeral 125 represents a free terminal of the second rotating frame 120, to which the handle 130 is connected. Further, reference numeral b2 represents a screw member to connect the second rotating frame 120 and the second hinge shaft 51.

The second stopper unit 150 includes the stopper 151, a stopper guide hole 152 provided on the lower end 22 of the first door 20 to guide forward and backward movement of the stopper 151, an elastic body 153 inserted into the stopper guide hole 152 to elastically support the stopper 151 in the outward direction of the first door 20, i.e., in the downward direction (with reference to FIG. 5A), and the locking part 154 provided on the second rotating frame 120 to be locked with the tip 151*a* of the stopper 151.

Reference numeral 24 represents a second cover connected to the lower end 22 of the first door 20 to prevent separation of the second hinge shaft 51, the second elastic body 53, the stopper 151, and the elastic body 153. The second cover 24 includes a plurality of screw holes 24*a*, through which connection screws are inserted, and a stopper hole 24*b*, through which the tip 151*a* of the stopper 151 is protruded.

The refrigerator 1 further includes a second cap 126 selectively connected to the second rotating frame 120. The second cap 126 is provided with a pressure part 126*a*. Under the condition that the second cap 126 is connected to the second rotating frame 120, the pressure part 126*a* of the second cap 126 applies pressure to the stopper 151 toward the first door 20 to release the locking of the stopper 151 with the locking part 154. Thereby, when the locking of the stopper 151 with the locking part 154 is released, restriction of rotation of the second rotating frame 120 relative to the first door 20 is released.

Under the condition that the handle 130 connected to the second rotating frame 120 closely approaches the first door 20, the tip 151*a* of the stopper 151 of the second stopper unit 150 is protruded from the lower end 22 of the first door 20 by a designated height and is inserted into the locking part 154 formed on the second rotating frame 120, and thus rotation of the second rotating frame 120 relative to the first door 20 is restricted. When the second cap 126 is connected to the second rotating frame 120, the pressure part 126*a* of the second cap 126 releases the locking of the tip 151*a* of the stopper 151 with the locking part 154 of the second rotating frame 120, and the second rotating frame 120 is rotated. Here, the guide part 123 provided on the second rotating frame 120 guides the tip 151*a* of the stopper 151, and defines a rotating section of the second rotating frame 120.

The second rotating frame 120 further includes an extension part 127 at the end thereof opposite to the free terminal 125, to which the handle 130 is connected, based on the center of rotation thereof, i.e., the second hinge hole 52. A rotating roller 128, which contacts the cabinet 10 and rolls, when the first door 20 is opened, is provided on the extension part 127.

Figure 6A:
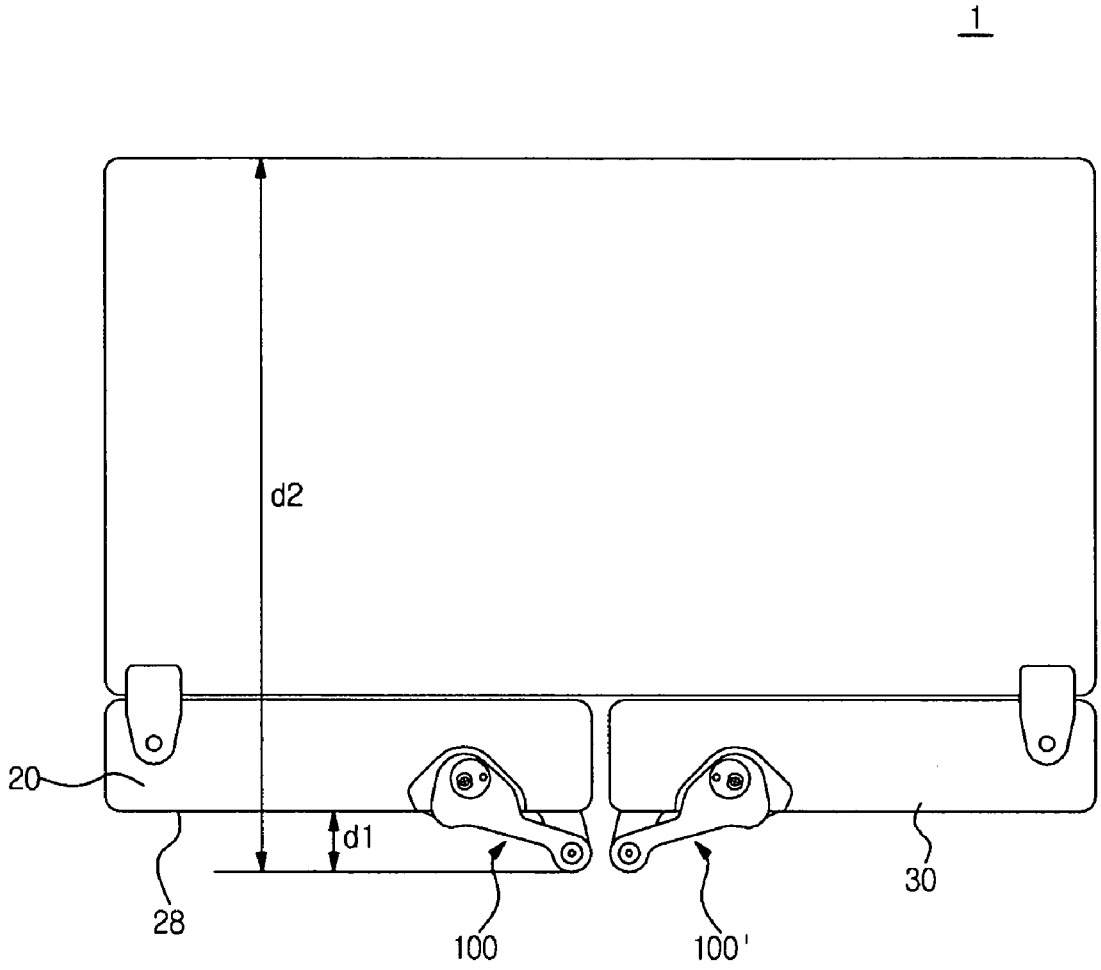
FIG. 6A is a plan view of the refrigerator in accordance with the embodiment of the present invention, illustrating a state in which the handle closely approaches the first door and thus the rotation of the handle is restricted.
Figure 6B:
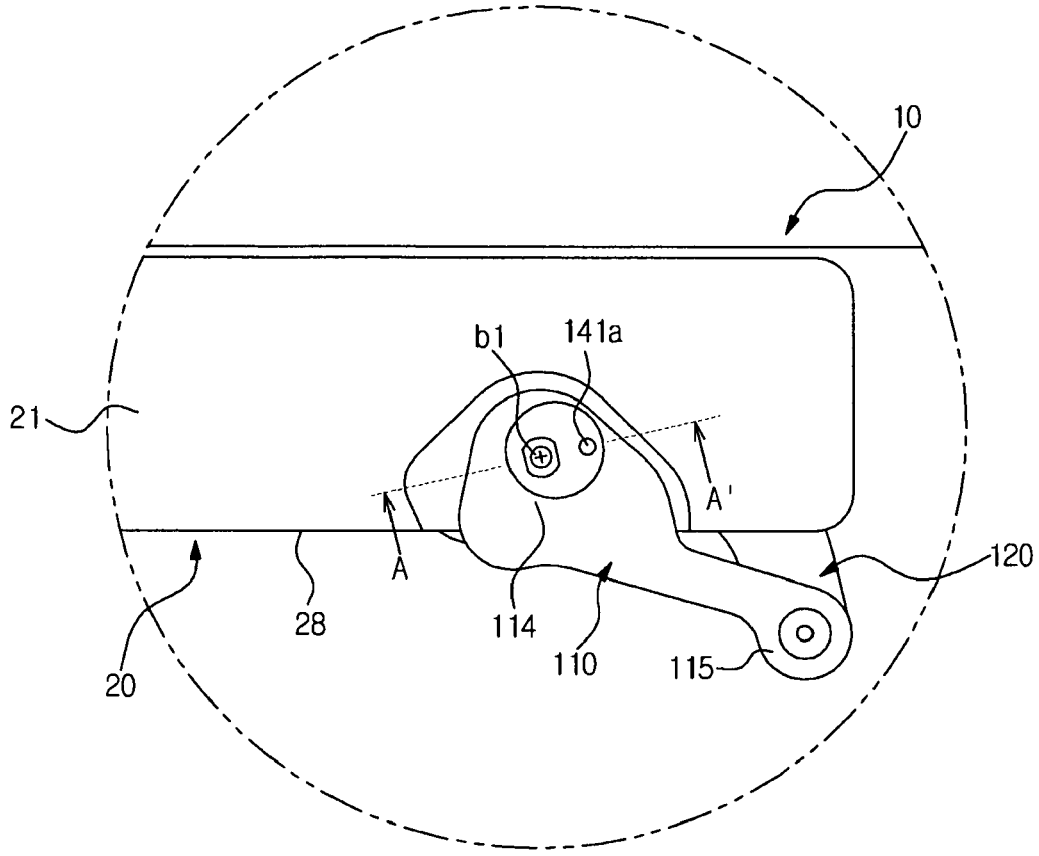
FIG. 6B is an enlarged view of the first rotating frame in the state of FIG. 6A.
Figure 6C:
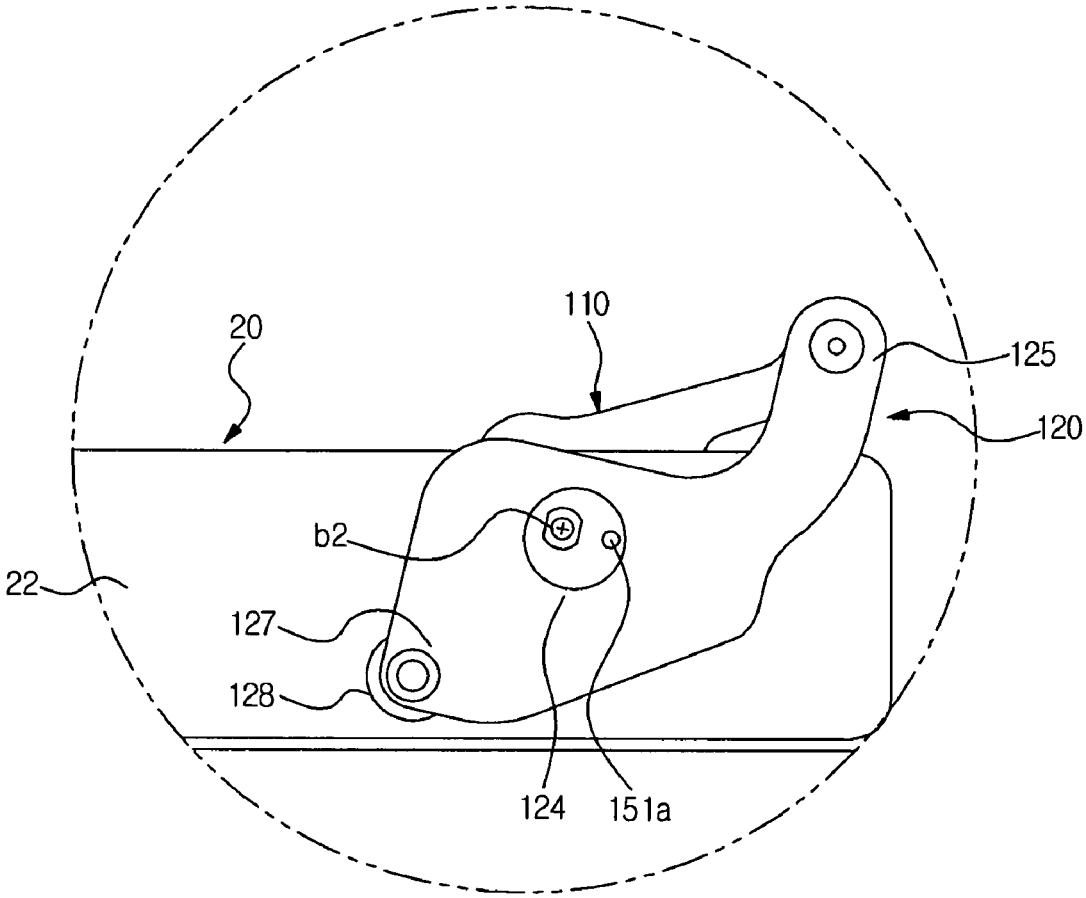
FIG. 6C is an enlarged view of the second rotating frame in the state of FIG. 6A.
Figure 6D:
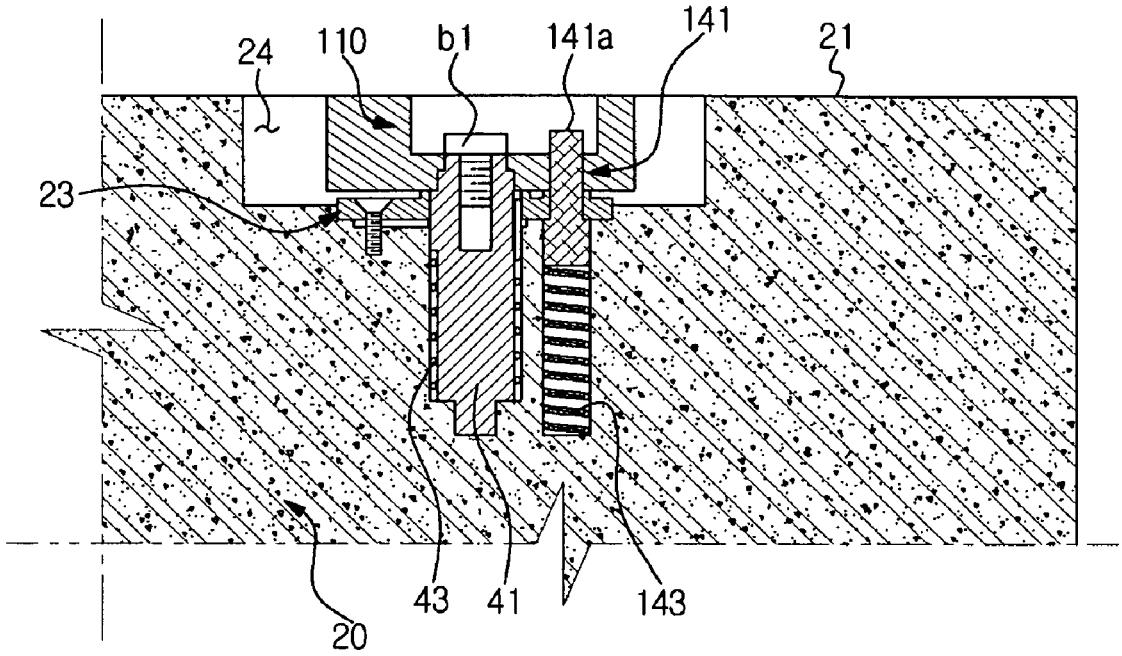
FIG. 6D is a longitudinal-sectional view taken along the line A-A' of FIG. 6B.
Figure 7A:
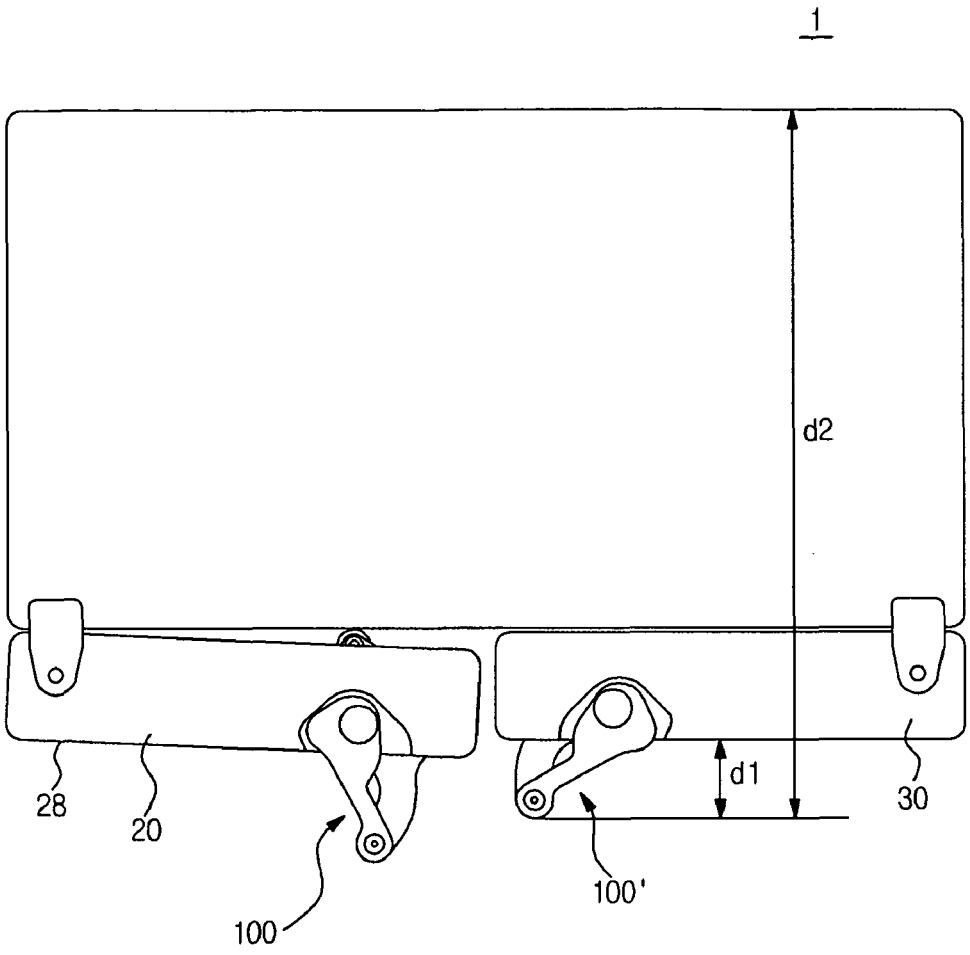
FIG. 7A is a plan view of the refrigerator in accordance with the embodiment, illustrating an opening operation of the first door using the handle.
Figure 7B:
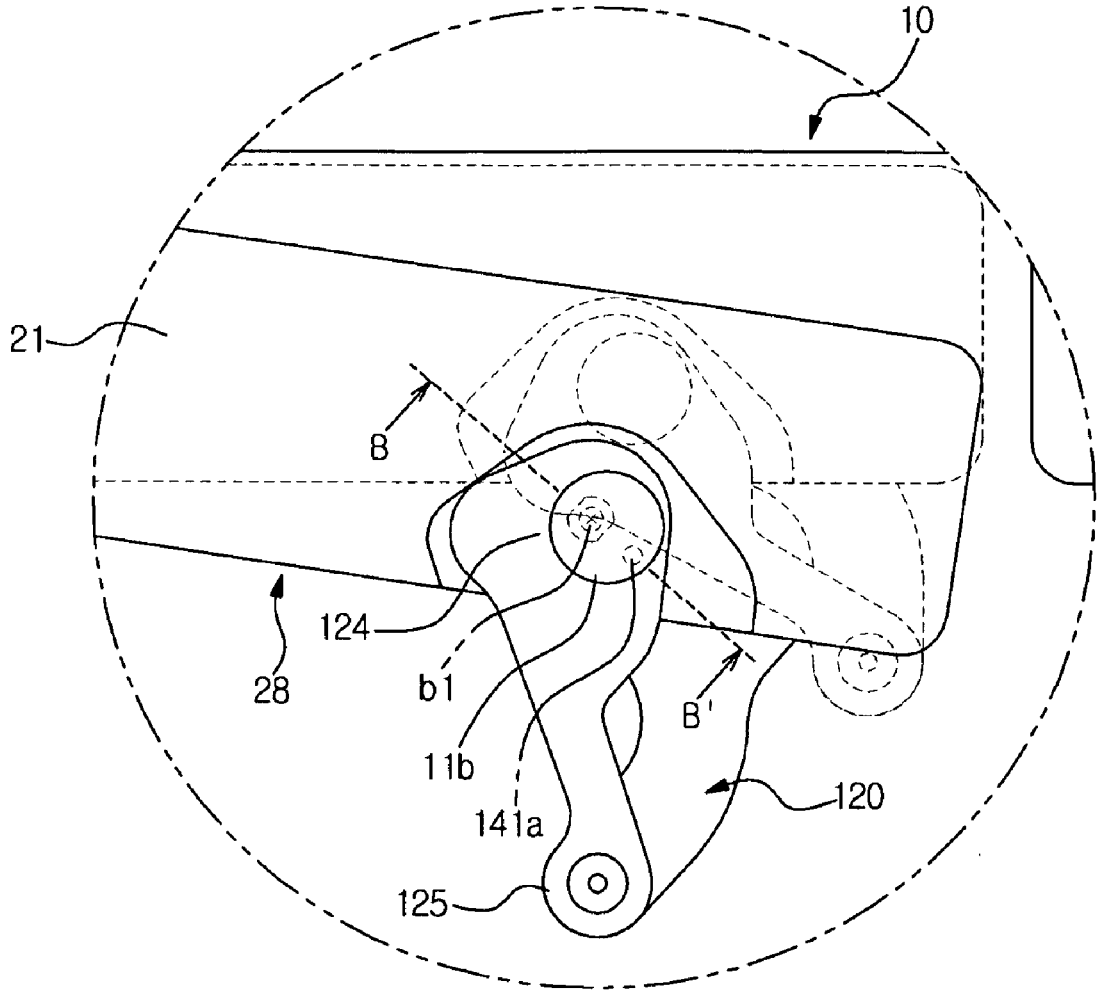
FIG. 7B is an enlarged view of the first rotating frame in the state of FIG. 7A.
Figure 7C:
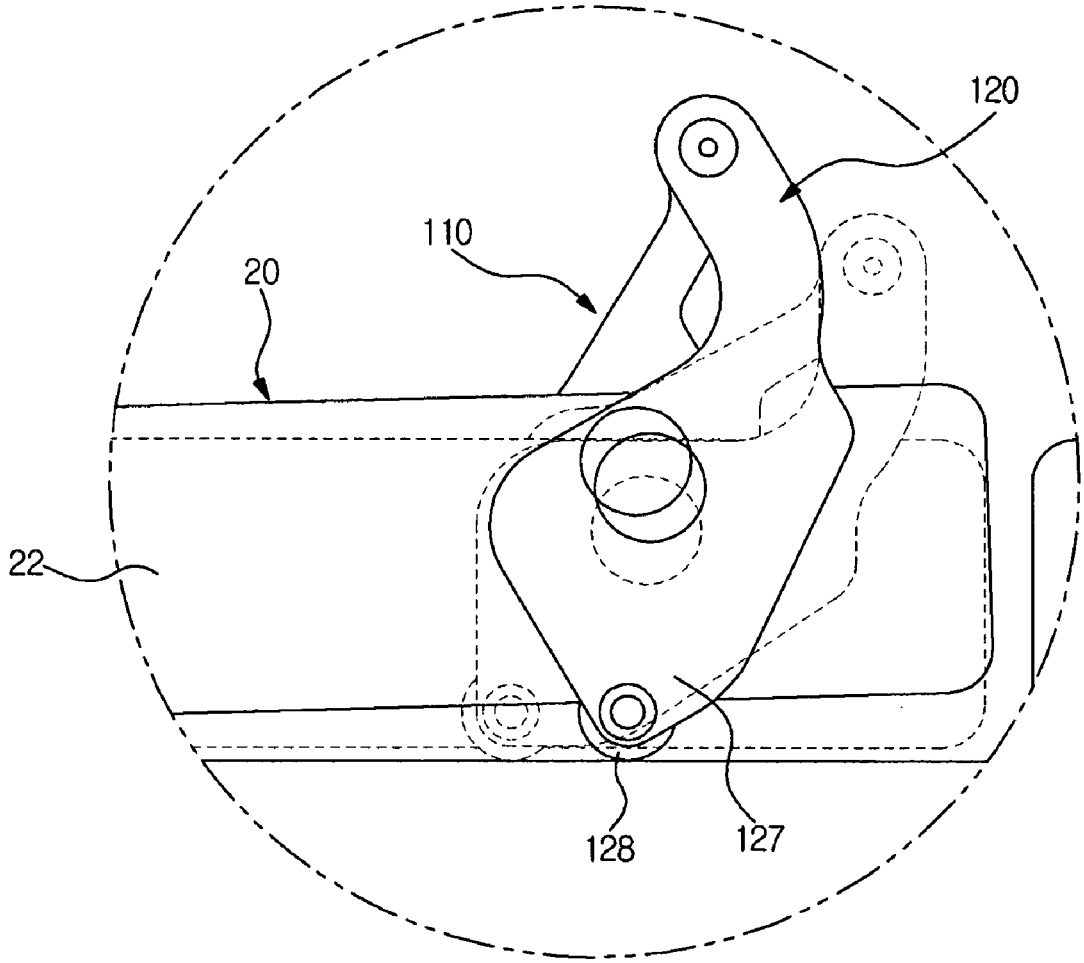
FIG. 7C is an enlarged view of the second rotating frame in the state of FIG. 7A.
Figure 7D:
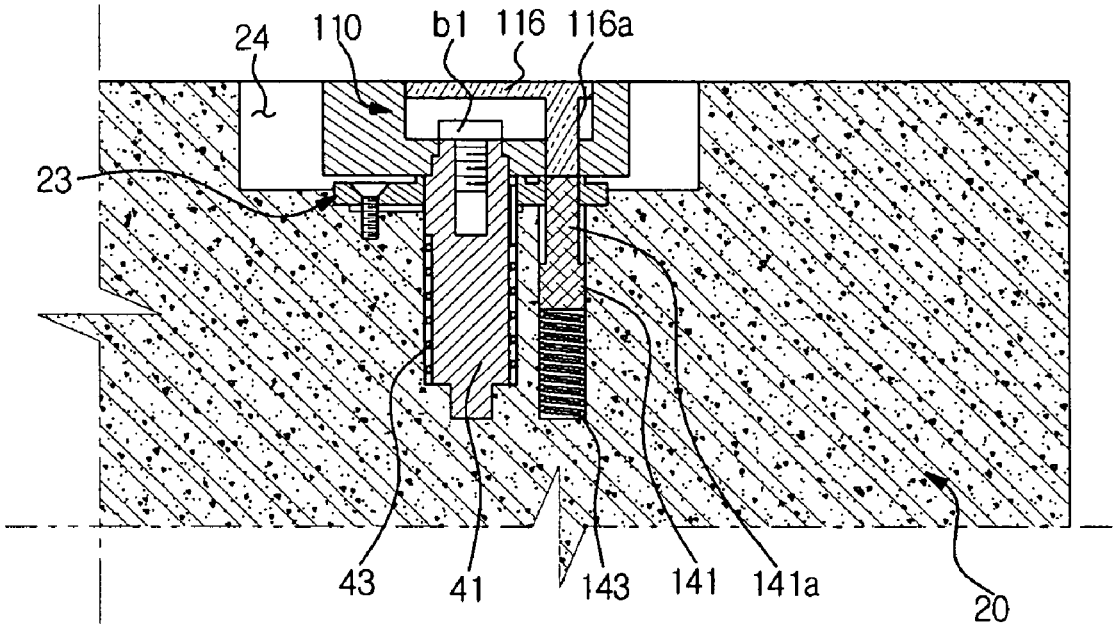
FIG. 7D is a longitudinal-sectional view taken along the line B-B' of FIG. 7B.

FIG. 6A is a plan view of the refrigerator in accordance with the embodiment, illustrating a state in which the handle closely approaches the first door and thus the rotation of the handle is restricted, FIG. 6B is an enlarged view of the first rotating frame in the state of FIG. 6A, FIG. 6C is an enlarged view of the second rotating frame in the state of FIG. 6A, and FIG. 6D is a longitudinal-sectional view taken along the line A-A' of FIG. 6B. Further, FIG. 7A is a plan view of the refrigerator in accordance with the embodiment, illustrating an opening operation of the first door using the handle, FIG. 7B is an enlarged view of the first rotating frame in the state of FIG. 7A, FIG. 7C is an enlarged view of the second rotating frame in the state of FIG. 7A, and FIG. 7D is a longitudinal-sectional view taken along the line B-B' of FIG. 7B.

As shown in FIGS. 6A to 6D, when the handle 130 is rotated toward the first door 20 and closely approaches the first door 20 under the state that the first cap 116 and the second cap 126 are respectively separated from the first rotating frame 110 and the second rotating frame 120, i.e., the locking part 144 of the first rotating frame 110 and the locking part 154 of the second rotating frame 120 are respectively opened, the locking part 144 of the first rotating frame 110 is locked with the stopper 141*a* provided on the upper end 21 of the first door 20, and the locking part 154 of the second rotating frame 120 is locked with the stopper 151*a* provided on the lower end 22 of the first door 20. Thereby, a distance d1 between the handle 130 and a front surface 28 of the first door 20 is reduced and maintained within a designated range, thus reducing a length d2 from the front surface to the rear surface of the refrigerator 1.

When the length d2 of the refrigerator 1 is reduced, a space occupied by the refrigerator 1 in transportation of the refrigerator 1 is reduced, and thus a relatively large number of refrigerators may be loaded in the same space and circulation efficiency is improved.

Further, the size of a refrigerator package is reduced, and a production cost is lowered. Of course, since the package is generally thrown away after installation of the refrigerator, the refrigerator in accordance with this embodiment is effective in resource saving.

Further, since the protruding height d1 of the handle 130 and the first and second rotating frames 110 and 120 from the front surface 28 of the first door 20 of the refrigerator 1 is reduced, components of the refrigerator 1 including the handle 130 are scarcely damaged by an external impact applied to the refrigerator 1 in transportation of the refrigerator 1.

As shown in FIGS. 7A to 7D, under the state that the first cap 116 and the second cap 126 are respectively connected to the first rotating frame 110 and the second rotating frame 120, i.e., the locking between the locking part 144 of the first rotating frame 110 and the tip 141*a* of the stopper 141 is released and the locking between the locking part 154 of the second frame 120 and the tip 151*a* of the stopper 151 is released, the first rotating frame 110 and the second rotating frame 120 are freely rotated within a designated range. Therefore, when a user pulls the handle 130, the first rotating frame 110 and the second rotating frame 120 connected to the handle 130 are freely rotated within the designated range, the rotating roller 128 provided on the extension part 127 of the second rotating frame 120 contacts the cabinet 10 by the rotation of the second rotating frame 120, rolls, and applies pressure to the cabinet 10. Based on the principle of a lever, although the handle 130 is pulled using a small force, a large pressure is applied to the cabinet 10. Accordingly, in the refrigerator in accordance with this embodiment, the first door 20 may be opened using a relatively small force.

On the contrary, when the user sets the handle 130, grasped to open the first door 20, free, the first rotating frame 110 and the second rotating frame 120 are rotated and returned to their original positions by the elastic force of the first elastic body 43 and the second elastic body 53.

In the refrigerator 1 in accordance with this embodiment, since the rotations of the rotating frames 110 and 120 may be restricted or the restriction of the rotations of the rotating frames 110 and 120 may be released only by connecting or separating the caps 116 and 126 to or from the rotating frames 110 and 120, as described above, users which are not skilled in mechanical assembly and disassembly, may easily maintain the close approach of the handle 130 to the first door 20 or change the state of the handle 130 into a rotatable state. However, the above-described caps 116 and 126 are exemplary elements provided with the pressure parts 116*a* and 126*a* to apply pressure to the stoppers 141 and 151, and other elements, which can apply pressure to the stoppers 141 and 151 to release the locking between the stoppers 141 and 151 and the locking parts 144 and 154, may be used without limit to names and shapes thereof.

Hereinafter, another embodiment will be described with reference to the accompanying drawings. Some parts in this embodiment, which are substantially the same as those in the earlier embodiment, are denoted by the same reference numerals even though they are depicted in different drawings, and a detailed description thereof will thus be omitted because it is considered to be unnecessary.

Figure 8A:
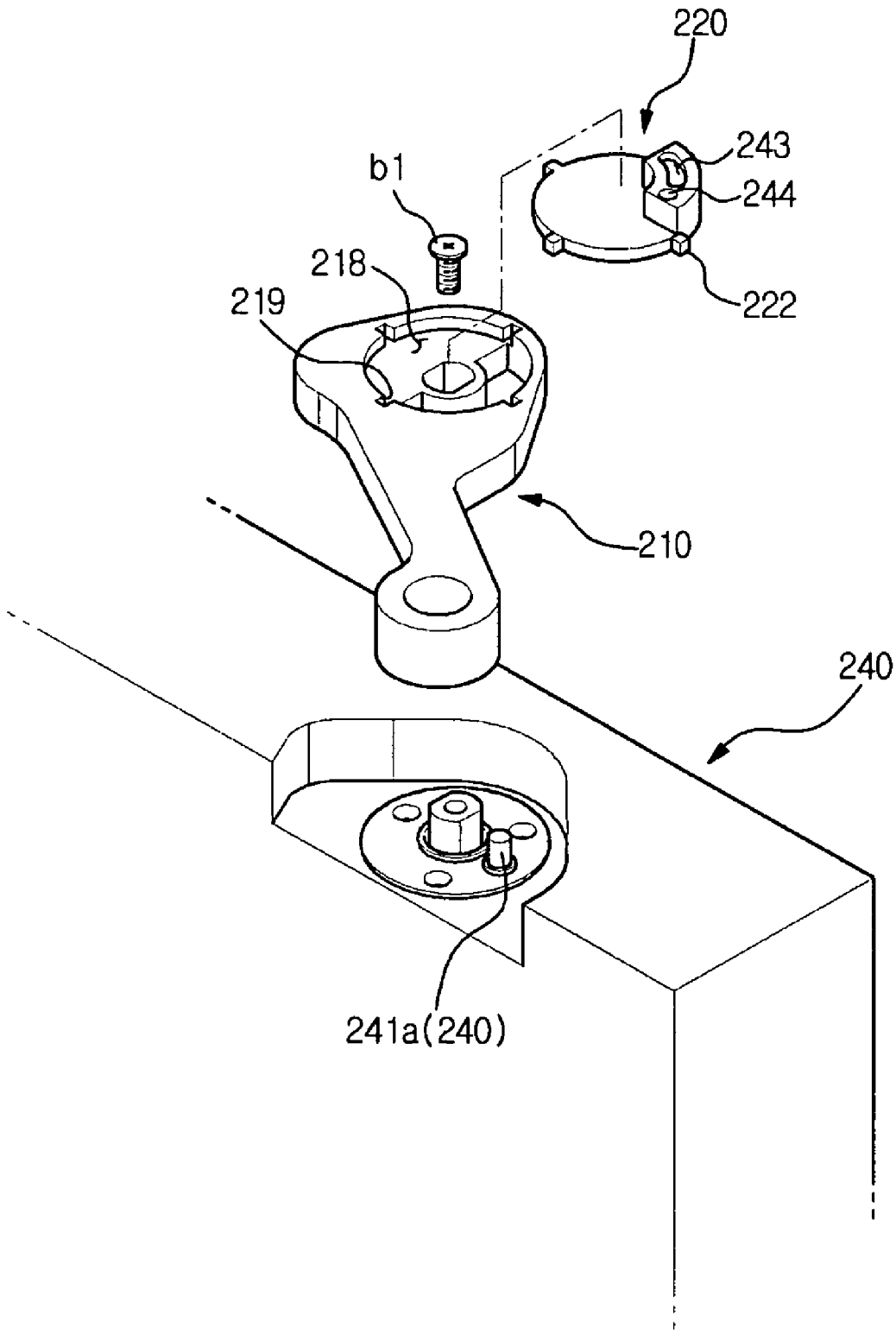
FIGS. 8A to 8C are views illustrating a connection structure of a first rotating frame and a first door of a refrigerator in accordance with another embodiment.
Figure 8B:
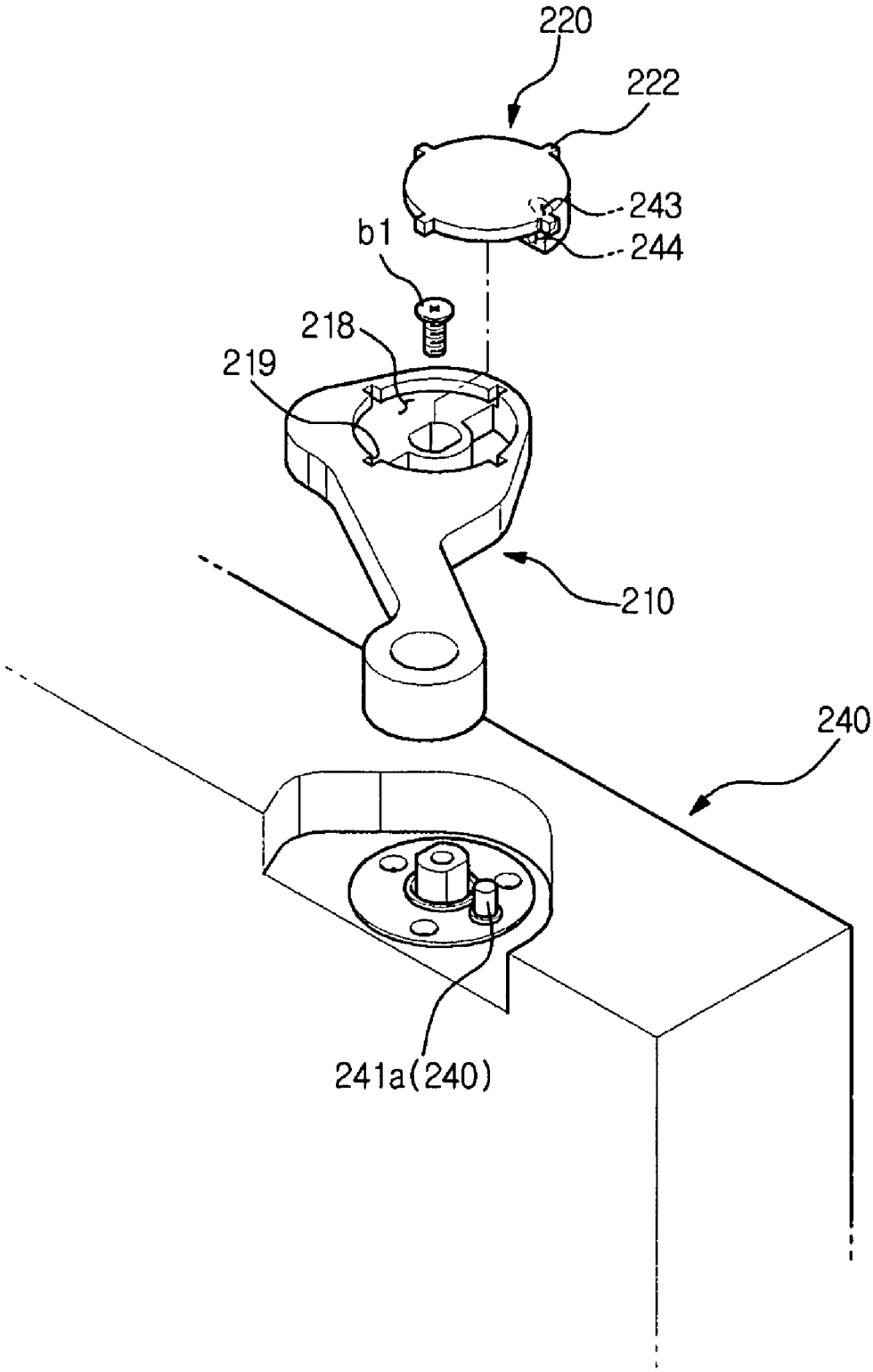
Figure 8C:
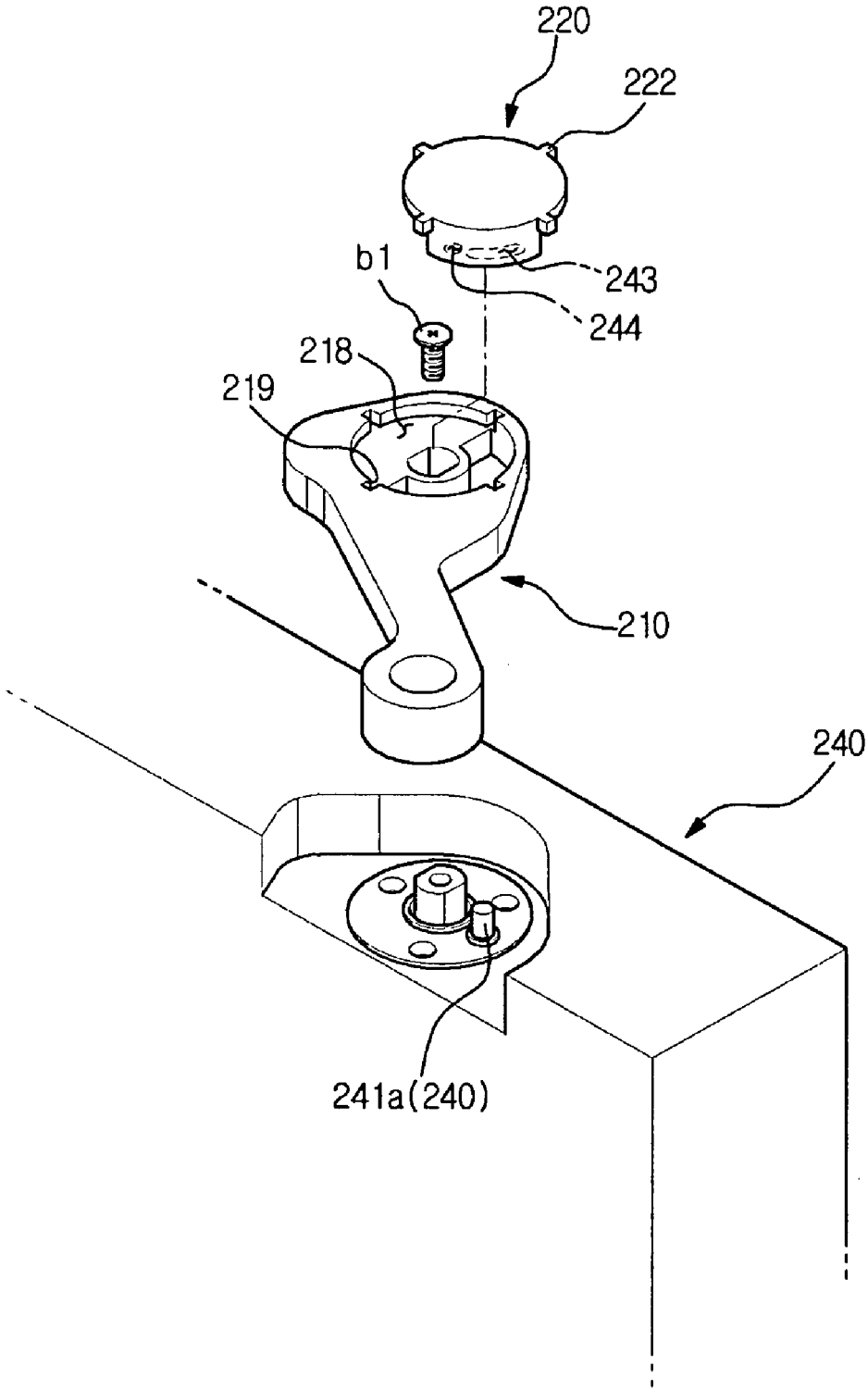

FIGS. 8A to 8C are views illustrating a connection structure of a first rotating frame and a first door of a refrigerator in accordance with this embodiment.

The refrigerator in accordance with this embodiment includes a locking frame 220 connected to a first rotating frame 210 to restrict relative rotation of the locking frame 220 relative to the first rotating frame 210. For this reason, a plurality of connection protrusions 222 is formed on an outer peripheral part 221 of the locking frame 220, and a plurality of connection holes 219 corresponding to the plurality of connection protrusions 222 is formed on a connection part 218 of the first rotating frame 210, to which the locking frame 220 is connected. Of course, the locking frame 220 and the connection part 218 of the first rotating frame 210 may be formed in a polygonal shape.

A locking part 244 and a guide part 243 are provided on the locking frame 220. The locking frame 220 may be connected to the first rotating frame 210 in one orientation out of a first orientation (with reference to FIG. 8B) and a second orientation (with reference to FIG. 8C). In case that the locking frame 220 is connected to the first rotating frame 210 in the first orientation, a tip 241*a* of a stopper 241 of a first stopper unit 240 is locked with the locking part 244 of the locking frame 220, and thus the rotation of the first rotating frame 210 is restricted and the close approach state of the handle 130 (with reference to FIG. 1) to the first door 20 is maintained. Further, in case that the locking frame 220 is connected to the first rotating frame 210 in the second orientation, the tip 241*a* of the stopper 241 of the first stopper unit 240 is inserted into the guide part 243, and is guided by the guide part 243.

Although the locking part 244 and the guide part 243 in this embodiment are respectively provided on the locking frame 240, the locking part 244 and the guide part 243 may be connected into one hole. Further, the locking frame 220 may be connected to the first rotating frame 220 in three or more orientations. Here, rotating ranges of the rotating frame 220 in the respective orientations are restricted to different values.

Further, the stopper 241 in this embodiment may be a simple protrusion protruding from the upper end 21 of the first door 20. That is, the refrigerator in this embodiment may omit an elastic body to elastically support the stopper 241.

Moreover, although the first rotating frame 220 connected to the upper end 21 of the door 20 is exemplarily described, the structure in this embodiment may be applied also to a second rotating frame.

Figure 9:
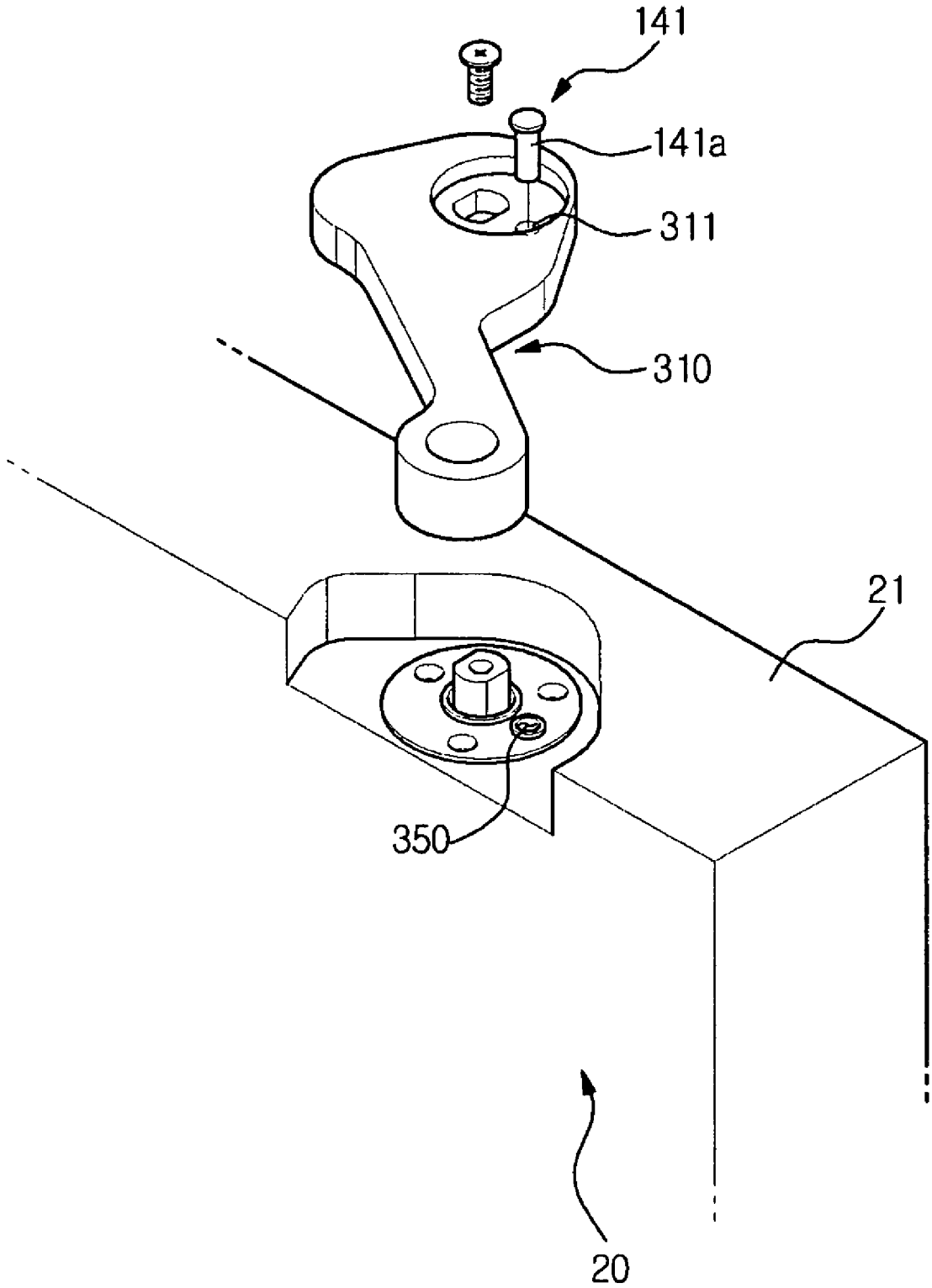
FIG. 9 is a view illustrating a connection structure of a first rotating frame and a first door of a refrigerator in accordance with a further embodiment.

FIG. 9 is a view illustrating a connection structure of a first rotating frame and a first door of a refrigerator in accordance with a further embodiment.

A stopper unit 340 in this embodiment includes a through hole 311 formed through a first rotating frame 310, a fixing hole 350 formed on the upper end 21 of the first door 20 to correspond to the through hole 311, and a stopper 141 provided with a tip 141*a* inserted into the fixing hole 350 via the through hole 311 at a designated rotating angle of the rotating frame 310 to restrict the relative rotation of the rotating frame 310 relative to the first door 20.

It is apparent that the embodiments may be variously modified.

For example, although one embodiment illustrates the rotating roller provided on the extension part of the second rotating frame, the extension part may be provided on at least one of the first rotating frame and the second rotating frame. Further, the rotating roller may be provided on the extension part provided on the at least one of the first rotating frame and the second rotating frame. Of course, the rotating roller may be omitted, and the extension part may apply pressure directly to the cabinet.

Although the embodiments of the present invention illustrate that the connection structure between the first rotating frame and the first door and the connection structure between the second rotating frame and the first door may be similar to each other, the first rotating frame and the second rotating frame may be connected to the first door in different structures.

Further, the first rotating frame and the second rotating frame provided on the upper end and the lower end of the door may be covered with separate housings and covers. Therefore, the upper end and the lower end of the first door, which are stated above, do not limit an end of the upper portion and an end of the lower portion of the first door.

Although the embodiments of the present invention illustrate a side-by-side type refrigerator, in which a freezing chamber and a refrigerating chamber are respectively formed at the left side and the right side, the embodiments may be applied to various type refrigerators including a one door type refrigerator.

The stopper unit may be provided on one end out of the upper end and the lower end of the door to selectively restrict rotation of at least one out of the first rotating frame and the second rotating frame relative to the door.

As is apparent from the above description, the refrigerator in accordance with the embodiments has improved circulation efficiency and durability. Further, the refrigerator in accordance with the embodiments has various reasonable functions.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator, which has a cabinet provided with at least one storage chamber, a door hinged to the cabinet to open and close the at least one storage chamber, and a door opening device provided on the door to open the door, the door opening device comprising:

a first rotating frame and a second rotating frame rotatably hinged to an upper end and a lower end of the door;

a handle extended in the longitudinal direction of the door, and provided with one end connected to one end of the first rotating frame and the other end connected to one end of the second rotating frame; and a stopper unit to selectively restrict rotation of at least one of the first rotating frame and the second rotating frame relative to the door to maintain an interval between the handle and the door within a designated distance.

2. The refrigerator according to claim 1, wherein the stopper unit includes:

a stopper protruding from at least one end out of the upper end and the lower end of the door; and a locking part provided on at least one out of the first rotating frame and the second rotating frame to be locked with a tip of the stopper.

3. The refrigerator according to claim 2, wherein the stopper unit further includes:

a stopper guide hole provided on the at least one end out of the upper end and the lower end of the door to guide forward and backward movement of the stopper; and an elastic body inserted into the stopper guide hole to elastically support the stopper.

4. The refrigerator according to claim 3, wherein the door opening device further comprises a cap selectively connected to the rotating frame provided with the locking part, wherein the cap is provided with a pressure part applying pressure to the stopper toward the door to release the locking of the stopper with the locking part under the condition that the cap is connected to the rotating frame.

5. The refrigerator according to claim 4, wherein the rotating frame provided with the locking part includes a guide part to guide the tip of the stopper when the first rotating frame and the second rotating frame are rotated.

6. The refrigerator according to claim 1, wherein:

an extension part is provided at the other end of at least one of the first rotating frame and the second rotating frame, being opposite to the end thereof, to which the handle is connected, based on the center of rotation thereof; and the extension part selectively applies pressure to the cabinet according to the rotations of the first rotating frame and the second rotating frame.

7. The refrigerator according to claim 6, wherein a rotating roller is provided on the extension part, and the rotating roller contacts the cabinet and rolls on the cabinet to apply pressure to the cabinet when the door is opened.

8. The refrigerator according to claim 2, wherein the door opening device further comprises a locking frame provided with the locking part, wherein the locking frame is connected to the rotating frame corresponding to the stopper such that relative rotation of the locking frame against the rotating frame is restricted.

9. The refrigerator according to claim 8, wherein:

the locking frame is connected to the rotating frame in at least two orientations, and is provided with a guide part, into which the tip of the stopper is inserted to be guided;

if the locking frame is connected to the rotating frame in a first orientation, the locking part of the locking frame is locked with the tip of the stopper and thus the rotation of the rotating frame is restricted; and if the locking frame is connected to the rotating frame in a second orientation, the tip of the stopper is inserted into the guide part of the locking frame and guided by the guide part, when the rotating frame is rotated.

10. The refrigerator according to claim 1, wherein the stopper unit includes a through hole formed through at least one of the first rotating frame and the second rotating frame, a fixing hole formed on one end of the door corresponding to the through hole, and a stopper provided with a tip inserted into the fixing hole via the through hole at a designated rotating angle of the rotating frame provided with the through hole to restrict the rotation of the rotating frame relative to the door.

11. A refrigerator, which has a cabinet provided with at least one storage chamber, a door hinged to the cabinet to open and close the at least one storage chamber, and a door opening device provided on the door to open the door, the door opening device comprising:

a shaft reception hole provided on at least one end of an upper end and a lower end of the door;

a shaft received in the shaft reception hole;

a rotating frame provided with one end connected to the shaft and the other end connected to a handle;

an elastic body to elastically bias the rotating frame; and a stopper provided on the door to selectively restrict rotation of the rotating frame relative to the door to maintain an interval between the handle and the door within a designated distance.

12. The refrigerator according to claim 11, wherein:

the stopper is provided on the door such that the stopper is movable between a first position and a second position;

at the first position, locking between the stopper and the corresponding rotating frame is generated and the rotation of the rotating frame is restricted to maintain a close approach state of the handle to the door; and at the second position, the locking between the stopper and the corresponding rotating frame is released.

13. The refrigerator according to claim 11, wherein the door opening device further comprises:

a stopper guide hole provided on the door; and an elastic body inserted into the stopper guide hole to elastically support the stopper.

14. The refrigerator according to claim 11, wherein the door opening device further comprises a cap connected to the rotating frame, wherein the cap applies pressure to the stopper to release the restriction of the rotation of the rotating frame by the stopper.

15. A refrigerator, which has a cabinet provided with at least one storage chamber, a door hinged to the cabinet to open and close the at least one storage chamber, and a door opening device provided on the door to open the door, the door opening device comprising:

a handle rotatable relative to the door;

at least one rotating frame to connect the door and the handle, the at least one rotating frame pressing the cabinet when the handle rotates, thereby opening the door; and a stopper unit to restrict rotation of the handle, wherein the door opening device has a first mode, in which the handle rotates relative to the door, to open the door, and a second mode, in which the stopper unit restricts rotation of the handle, to fix the handle relative to the door thereby maintaining an interval between the handle and the door within a designated distance.

* * * * *

UNITED STATES PATENT AND TRADEMARK OFFICE

CERTIFICATE OF CORRECTION

PATENT NO. : 8,356,866 B2
APPLICATION NO. : 12/659028
DATED : January 22, 2013
INVENTOR(S) : Cho et al.

It is certified that error appears in the above-identified patent and that said Letters Patent is hereby corrected as shown below:

In the Claims

Line 14, Column 12, In Claim 15, delete "door thereby" and insert -- door, thereby --, therefor.

Signed and Sealed this
Fifteenth Day of October, 2013

Teresa Stanek Rea
*Deputy Director of the United States Patent and Trademark Office*